US005896585A

United States Patent [19]

Stazo

[11] Patent Number: 5,896,585

[45] Date of Patent: Apr. 27, 1999

[54] DEVICE TO MOUNT ITEMS ON HEADGEAR

[76] Inventor: Jack Stazo, 10606 N. Evers, Houston, Tex. 77024

[21] Appl. No.: 08/964,730

[22] Filed: Nov. 5, 1997

Related U.S. Application Data

[60] Provisional application No. 60/030,087, Nov. 5, 1996.

[51] Int. Cl.[6] ..... A42B 1/24

[52] U.S. Cl. ..... 2/209.13; 2/244

[58] Field of Search ..... 2/209.13, 209.14, 2/422, 244; 24/30.55; 40/329

[56] References Cited

U.S. PATENT DOCUMENTS

| | | | |
|---|---|---|---|
| 1,744,083 | 1/1930 | Schmidt | 24/30.5 S |
| 4,760,624 | 8/1988 | Fish | 24/30.5 S |
| 4,881,654 | 11/1989 | Stazo et al. | 220/85 H |
| 5,070,546 | 12/1991 | Stazo et al. | 2/199 |
| 5,495,645 | 3/1996 | Suzuki et al. | 24/30.5 S |

*Primary Examiner*—Diana L. Biefeld
*Attorney, Agent, or Firm*—Kenneth H. Johnson

[57] ABSTRACT

A device or ornament to be mounted on a bottom on a cap by means of a bottom on the device or ornament having a slot or slit running from one side of the bottom with a centrally positioned opening in the bottom adapted to snap around the button attachment at the apogee of a cap and to hold the device on the cap.

5 Claims, 1 Drawing Sheet

DEVICE TO MOUNT ITEMS ON HEADGEAR

This application claims the benefit of provisional application Ser. No. 60/030,087 filed Nov. 5, 1996, now abandoned.

BACKGROUND OF THE INVENTION

1. Field of the Invention

The present invention relates to a device, which may be mounted on a cap or other headgear having a button located near the apex.

2. Related Art

U.S. Pat. Nos. 4,881,654 and 5,070,546 disclose a system for mounting useful containers and decorative, novelty or distinguishing items may be attached to headgear to be conspicuously obvious without interference with other activities.

SUMMARY OF THE INVENTION

Briefly, the present invention comprises a device having a bottom having a slot or slit with an opening at the end of the slit or positioned along the slit to snap on to a button, or other knob like protrusion on headgear and the combination comprising said device and said headgear. More preferably the button or knob is located on the headgear, such that it will be at approximately the apogee of the headgear in the normal upright position with the headgear in place on the wearer. Preferably the headgear will be a hat or cap and the button will be a button located at the upper center of the hat or cap. In another aspect of the invention the container may be permanently affixed to the headgear.

The item may be made of any material and the bottom may be the same provided that there is sufficient flexibility and resilience for the bottom to deform to allow the button to pass along slit and seat in the opening

DETAILED DESCRIPTION

Figure 1:
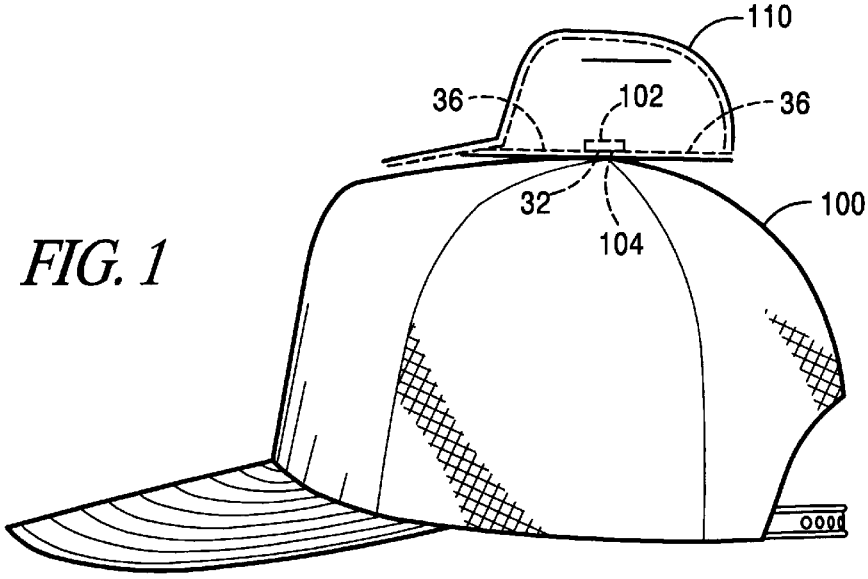
FIG. 1 is a side elevational cross section of a device in the form of a miniature baseball cap in place on a cap.

Referring to FIG. 1, the device 110 is a opaque plastic ornament made in the shape of a miniature, base ball cap, preferably in a team color with a team logo on it. The device 110 has bottom 22. The bottom is made of plastic which is rigid yet flexible thus allowing the sides of slot 36 to deform when pressed by hand (not shown) along a button attachment 102 of cap 100 and to seat on the button as shown in FIG. 1. The slot extends through at least one edge 22*a* of the bottom to allow the bottom to slide along the bottom attachment.

When the deformed slot 36 returns to its normal position, the slot is reduced in size, thus preventing the bottom from falling off the button 102. Removing the device is the reverse operation, whereby the slot is deformed to allow the button to pass out along the slot. The button may be locked in place thereby permanently attaching the device and headgear. However in the preferred embodiment the device will not be permanently locked in place thus allowing the wearer to change the device, e.g. a miniature football (not shown) or football helmet for football season.

Figure 2:
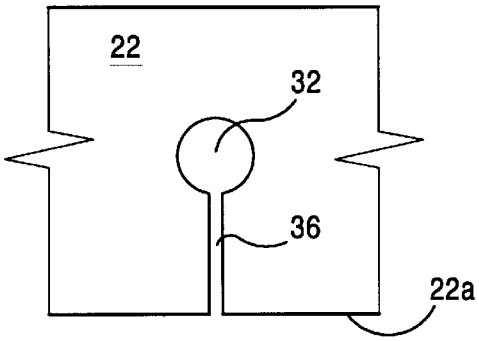
FIG. 2 is a detail of one embodiment of the opening in the bottom of the container.
Figure 3:
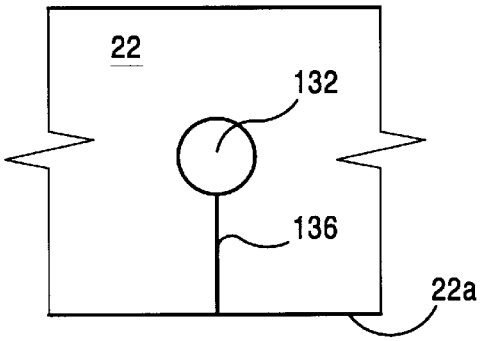
FIG. 3 is an alternative bottom opening embodiment.

In FIG. 2 opening 32 is positioned at the end of the slot 36 although the slot could extend beyond the opening. The opening may be located in the middle of the bottom or at any position on the bottom. The location of the opening will depend on the device being attached to the cap. For a relatively symmetrical device the opening would likely be centered, whereas an elongated shape may be best mounted toward one end. A suitable plastic for this is a medium density polypropylene which is rigid yet flexible thus allowing the individual slot 36 to deform FIG. 3 shows an alternative type of mounting which slot is a slit 136 with a central hole 132. The button 102 should be larger than the hole 32 or 132. The slot is elongated cut in the bottom with the sides spaced apart, whereas the slit is has no space between the sides and may even have an over lap of the sides.

Figure 4:
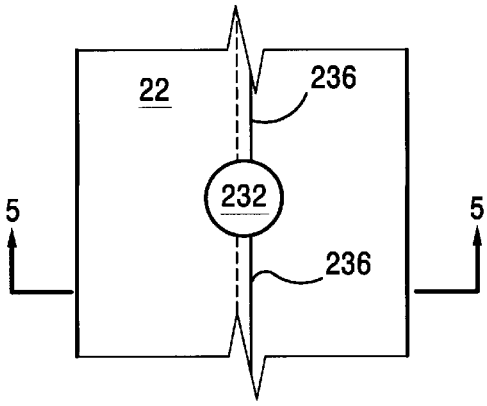
FIG. 4 is a second alternative bottom opening embodiment.
Figure 5:
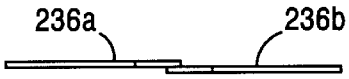
FIG. 5 is a side view of the bottom taken along 5—5.

FIG. 4 is a further variation on the embodiment of FIG. 3. The opening 232 has a slit 236 extend on both sides to allow deformation and the admission of button through the hole. The slit does not extend to an edge of bottom 22. The slit is formed by overlapped portion 236*a* and 236*b* as shown in FIG. 5.

Preferably the button on the cap is centrally located and at the apogee of the headgear.

The invention claimed is:

1. In combination:

(a) a headgear having a button attached thereon and (b) a device having a bottom, said bottom having an opening therein and a circumferencial edge thereabout, said opening being located along a slot which extends through said circumferencial edge and which is deformable to allow attachment of said device to said button on said headgear by sliding along the slot into said opening for receiving and holding the button.

2. The combination according to claim 1 wherein said button is centrally positioned on said headgear.

3. The combination according to claim 2 wherein said button is positioned at the apogee of said headgear.

4. The combination according to claim 3 wherein said opening is centrally positioned in said bottom.

5. The combination according to claim 4 wherein said slot is a slit.

* * * * *